US006021722A

United States Patent [19]

Raycraft

[11] Patent Number: 6,021,722

[45] Date of Patent: Feb. 8, 2000

[54] VERTICALLY ADJUSTABLE DESK LIFTING DEVICE

[76] Inventor: Marc E. Raycraft, 4564 Arborwalk Ct., Stone Mountain, Ga. 30083

[21] Appl. No.: 09/162,223

[22] Filed: Sep. 28, 1998

[51] Int. Cl.[7] ..... A47B 9/00

[52] U.S. Cl. ..... 108/147; 248/188.2

[58] Field of Search ..... 108/147, 147.21, 108/147.2, 147.19, 144.11, 10; 248/439, 188, 118.5, 188.2

[56] References Cited

U.S. PATENT DOCUMENTS

| | | | |
|---|---|---|---|
| 3,080,835 | 3/1963 | Guglielmi | 108/147 X |
| 3,825,244 | 7/1974 | Bauer | 108/147 X |
| 4,894,600 | 1/1990 | Kearney . | |
| 4,979,718 | 12/1990 | Bauer et al. . | |
| 5,174,223 | 12/1992 | Nagy et al. | 108/50.01 |
| 5,437,236 | 8/1995 | Zeiner . | |
| 5,526,898 | 6/1996 | Clark . | |
| 5,531,413 | 7/1996 | Wolf et al. . | |
| 5,553,550 | 9/1996 | Doyle . | |
| 5,562,052 | 10/1996 | Glashouwer et al. | 108/147.21 |
| 5,598,788 | 2/1997 | Jonker . | |
| 5,620,067 | 4/1997 | Bauer et al. . | |
| 5,636,394 | 6/1997 | Bartley | 108/147 X |

FOREIGN PATENT DOCUMENTS

| | | | |
|---|---|---|---|
| 1203478 | 1/1960 | France | 108/147 |

*Primary Examiner*—Jose V. Chen

*Attorney, Agent, or Firm*—Barry E. Kaplan, Esq.; Hughes & Kaplan

[57] ABSTRACT

Provided is a vertically adjustable desk lifting device having a plurality of gas pressurized cylinders for urging a desk in an upward direction, thereby facilitating the raising and lowering of a desk by a single user. The desk can be locked into a multitude of vertical positions and easily released via a foot pedal. The lifting device comprises a pair of spaced-apart gas pressurized cylinders positioned on both sides of a desk. The gas pressurized cylinders are chosen or calibrated to provide an adequate upward force to slightly urge the desk in the upward direction, depending upon the weight of the desk and the distribution of such weight. Additional gas pressurized cylinders can be easily inserted adjacent any one of the four standard gas pressurized cylinders to counter-balance the weight distribution of the desk if needed. Positioned between the two gas pressurized cylinders is a locking mechanism, comprising telescoping cylindrical members and a hinged-pin and spring arrangement, for stabilizing and securing the desk in a desired vertical position. A foot pedal and cables are provided to release the locking mechanism.

16 Claims, 2 Drawing Sheets

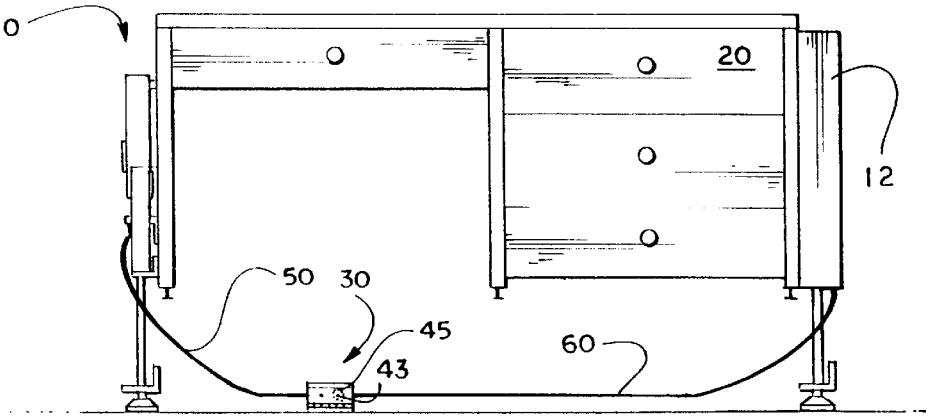
Fig. 2
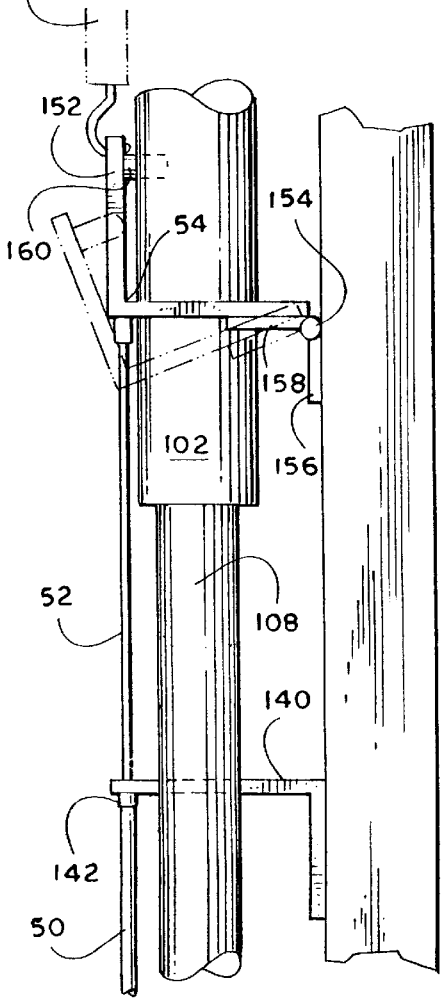
Fig. 3
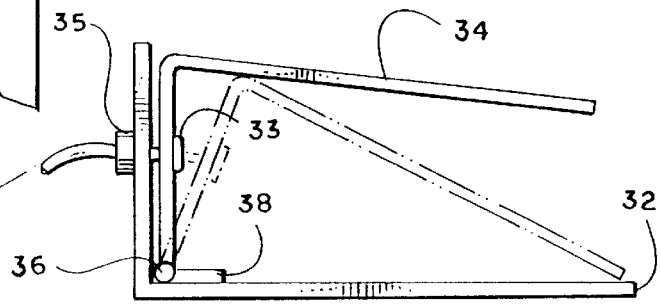

VERTICALLY ADJUSTABLE DESK LIFTING DEVICE

FIELD OF THE INVENTION

This invention relates generally to lifting devices, and more particularly to a new and improved vertically adjustable desk lifting device capable of being locked in a multitude of vertical positions and requiring minimum effort in raising and lowering a desk.

BACKGROUND OF THE INVENTION

Desks are some of the most widely used articles of manufacture in today's society. Desks can be found in offices, homes, schools, libraries and many other facilities, and, as such, are utilized for a multitude of applications. However, with most desks, the vertical position relative to the floor is fixed and can not be adjusted. This creates numerous problems for many individuals.

For example, a disadvantaged group as a result of non-vertically adjustable desks are the millions of individuals that suffer from back pain and discomfort. For many of these individuals, sitting in a chair for extended periods of time can cause severe back pain. Consequently, frequent standing breaks and/or walking breaks must be taken in order to help alleviate some of the pain and discomfort. In addition, many try working at their desk while standing; however, because the typical desk or table is in such a relatively low position when standing, working in this position is impractical and often results in neck pain and discomfort from looking down. Other medical conditions such as hemorrhoids also may be exasperated by extended periods of sitting.

Shorter and taller than normal individuals can also have problems with standard desks and tables. For instance, many office type chairs are designed to allow vertical adjustment; however, for shorter individuals, once the chair is adjusted so that the torso of the individual is at a comfortable height relative to the surface of the desk, the feet of the individual are typically raised off the floor, thereby increasing the pressure on the spine and reducing blood flow to the legs and feet. Consequently, over extended periods of time the individual may suffer back pain, especially in the lumbar region, and poor circulation in his or her legs and feet. For taller individuals, once the chair is adjusted so that the torso of the individual is at a comfortable height relative to the surface of the desk or table, the individual's legs are squashed and/or unable to fit under the desk.

Accordingly, the need for a vertically adjustable desk or has been long felt. However, not until relatively recently has this problem been addressed. For instance, in an attempt to eliminate or reduce some of the above-discussed disadvantages, a variety of solutions have been proposed. Examples of such attempts may be found by reference to U.S. Pat. No. 5,598,788 to Jonker and U.S. Pat. No. 5,553,550 to Doyle. Both Jonker and Doyle teach a vertically adjustable table having means for urging the table in the upward direction. Such devices, however, are disadvantageous in that they are not readily adaptable to preexisting tables and desks. In addition, the tables disclosed in Jonker and Doyle lack drawers and many attributes of a desk and therefore, are not suitable for use as such. Furthermore, neither device accounts for the varying in distribution of weight that may exist by virtue of the table design or by what items may be resting on the surface of the table.

Jonker and Doyle are further disadvantaged in the manner by which they are raised and lowered and in the manner by which they are secured at a desired vertical position. For instance, the Jonker design requires that the table be raised to the up-most position before it can be lowered. In other words, the latching means cannot be controlled independent of raising and lowering the table. The Doyle design requires either the use of an electric pump or a hand pump to insert or remove fluid from cylinders to raise or lower the table, respectively, both methods of which are relatively inefficient and costly.

Attempts were made to design a vertically adjustable work station more suitable for use as a desk with shelves and drawers, an example of which may be found by reference to U.S. Pat. No. 4,894,600 to Kearney. Kearney teaches in one embodiment, a work station that can be vertically adjusted by use of an electric motor. This type of system is relatively expensive, unnecessarily requires the use of electric power, and is not adaptable to preexisting desks. In a second embodiment, Kearney teaches the use of a manually adjustable work station. However, this manual system has many disadvantages. For instance, when the desk is raised or lowered, one must manually loosen fasteners on each leg, lift the corner of the table to a desired position and then manually tighten the fasteners. Because there is no means for urging the desk in the upward direction for the second embodiment, one must either lift each corner and secure it in place separately, which would most likely result in any objects on the top surface of the desk rolling off, or one would have to solicit the help of one or more individuals to lift the desk, maintaining a relatively level top surface, while another one or more individuals secured the legs into position. In other words, a single individual could not raise and/or lower the desk by himself while maintaining a relatively level top surface. In addition, similar to the first embodiment, the second embodiment of Kerney is not adaptable to preexisting desks or tables.

U.S. Pat. No. 5,526,898 to Clark discloses leg extension assemblies that can be attached to a multitude of devices for use in applications in which the ground surface is uneven relative to the other legs of the device. Although the Clark device may be adapted to fit most tables, it does not solve the long felt need addressed by the herein disclosed invention. In addition, because the Clark device attaches to an elongated member, it does not readily adapt to most desks having side panels and drawers. Furthermore, each leg extension assembly works independently of each other and, thus, does not operate at the same time to evenly raise and lower a table. Each latching mechanism must be manually unlatched to raise or lower the device.

Because of the wide-spread use of desks, coupled with the physical difficulties and limitations of many users, it is readily apparent that a new and improved vertically adjustable desk lifting device, adaptable to preexisting desks, capable of easily and evenly raising and lowering a desk by a single individual, and that can be secured at a multitude of vertical positions, is needed. It is, therefore, to the provision of such an improvement that the present invention is directed.

BRIEF SUMMARY OF THE INVENTION

In accordance with the several objects of this invention, presented is a vertically adjustable desk lifting device having gas pressurized cylinders for urging a desk in an upward direction, thereby facilitating the raising and lowering of a desk by a single user. The desk can be locked into a multitude of vertical positions and easily released via a foot pedal.

In a preferred embodiment, the present invention comprises a pair of gas pressurized cylinders positioned on both sides of a desk. The gas pressurized cylinders are chosen or calibrated to provide an adequate upward force to slightly urge the desk in the upward direction. The amount of force needed depends on the weight of the desk and the distribution of such weight. For instance, most desks are heavier on one side and often on one corner. If, for example, it is determined that for a specific desk that the front right corner is supporting 34% of the total weight while the other three corners are supporting 22% each of the total weight of the desk, then the gas pressurized cylinder for the 34% corner will be selected accordingly to balance the lifting of the desk so that the desk will be lifted uniformly to reduce the risk of items on the top surface from sliding or rolling off during the raising or lowering of the desk. An additional gas pressurized cylinder can be easily inserted adjacent any one of the four standard gas pressurized cylinders to counterbalance the weight distribution of the desk, if needed.

On each side of the desk, a pair of the gas pressurized cylinders are spaced apart and secured in position on the desk between an upper and lower bracket. The plunger rods of the gas pressurized cylinders are attached to a fixed base portion which serves to support the desk when the desk is in a raised position and to provide a fixed pressure plate for transferring the force of the gas pressurized cylinder to the upper bracket thereby urging the desk in the upward direction. Positioned between the two gas pressurized cylinders is a locking mechanism for securing the desk in a desired vertical position. The locking mechanism comprises two telescoping cylindrical member assemblies, each having a lower member and an upper member. The lower member is connected and supported by the base support while the upper member is attached to and supported by upper brackets. As the desk is raised or lowered, the upper and lower members telescope to allow free vertical movement of the desk and to provide added support and stability when the desk is in a raised position. Each of the upper telescoping members have one hole and each of the lower telescoping members have a plurality of holes vertically spaced apart, wherein a protruding pin on each telescoping member assembly extends through the hole of the upper telescoping member and through one of the plurality of holes in the lower telescoping member to lock the desk in the desired vertical position. The pins are urged toward the holes by a locking spring to ensure the desk remains locked when not being raised or lowered.

The pins are attached to a hinged mounting plate, which is attached to a foot pedal via a cable. When the pedal is depressed, the cable retracts; thereby, hinging the pin mounting plate and, thus, disengaging the pin from the current hole. Except for the variance in the gas pressurized cylinder force as discussed above, an identical arrangement is positioned on the other side of the desk. As such, when the pedal is depressed, all four pins are disengaged; thereby, allowing the lowering or raising of the desk. Because the force of the gas pressurized cylinders are chosen to slightly urge the desk in the upward direction, a slight hand force is applied to lower the desk. Once the desk is in the desired position, the foot pedal is released and the pins are reinserted within the corresponding holes of the upper and lower telescoping members.

Thus, a feature and advantage of the present invention is to provide a new and improved vertically adjustable desk lifting device having gas pressurized cylinders calibrated and/or chosen to account for variances in weight distribution in order to slightly urge the desk in the upward direction. Furthermore, the present invention is dimensioned and designed to allow the easy installation of additional gas pressurized cylinders, if needed.

Another feature and advantage of the present invention is to provide a new and improved vertically adjustable desk lifting device having gas pressurized cylinders calibrated and/or chosen to account for variances in weight distribution to maintain the desk in a relatively horizontal position to prevent objects inside and on the surface of the desk from sliding or rolling during the raising or lowering of the desk.

Another feature and advantage of the present invention is to provide a new and improved vertically adjustable desk lifting device having means for securing a desk in a plurality of vertical positions.

Another feature and advantage of the present invention is to provide a new and improved vertically adjustable desk lifting device having a foot pedal that controls all four locking pins so that a single individual can lower and raise a desk with ease and without assistance.

Another feature and advantage of the present invention is to provide a new and improved vertically adjustable desk lifting device that can be attached and adapted to preexisting desks and a variety of tables.

Other objects, features, and advantages of the present invention will become apparent to those skilled in the art by reference to the drawings and to the detailed description of the preferred embodiment presented herein.

BRIEF DESCRIPTION OF THE DRAWINGS

The invention is better understood by reading the Detailed Description of the Preferred Embodiments with reference to the accompanying drawing figures, in which like reference numerals denote similar structure and refer to like elements throughout, and in which:

FIG. 2 is a front view of a preferred embodiment of the present invention interconnected to a desk; and, FIG. 3 is a partial cutaway side view of the latching assembly mechanism of the preferred embodiment of the present invention interconnected to a desk.

Figure 1:
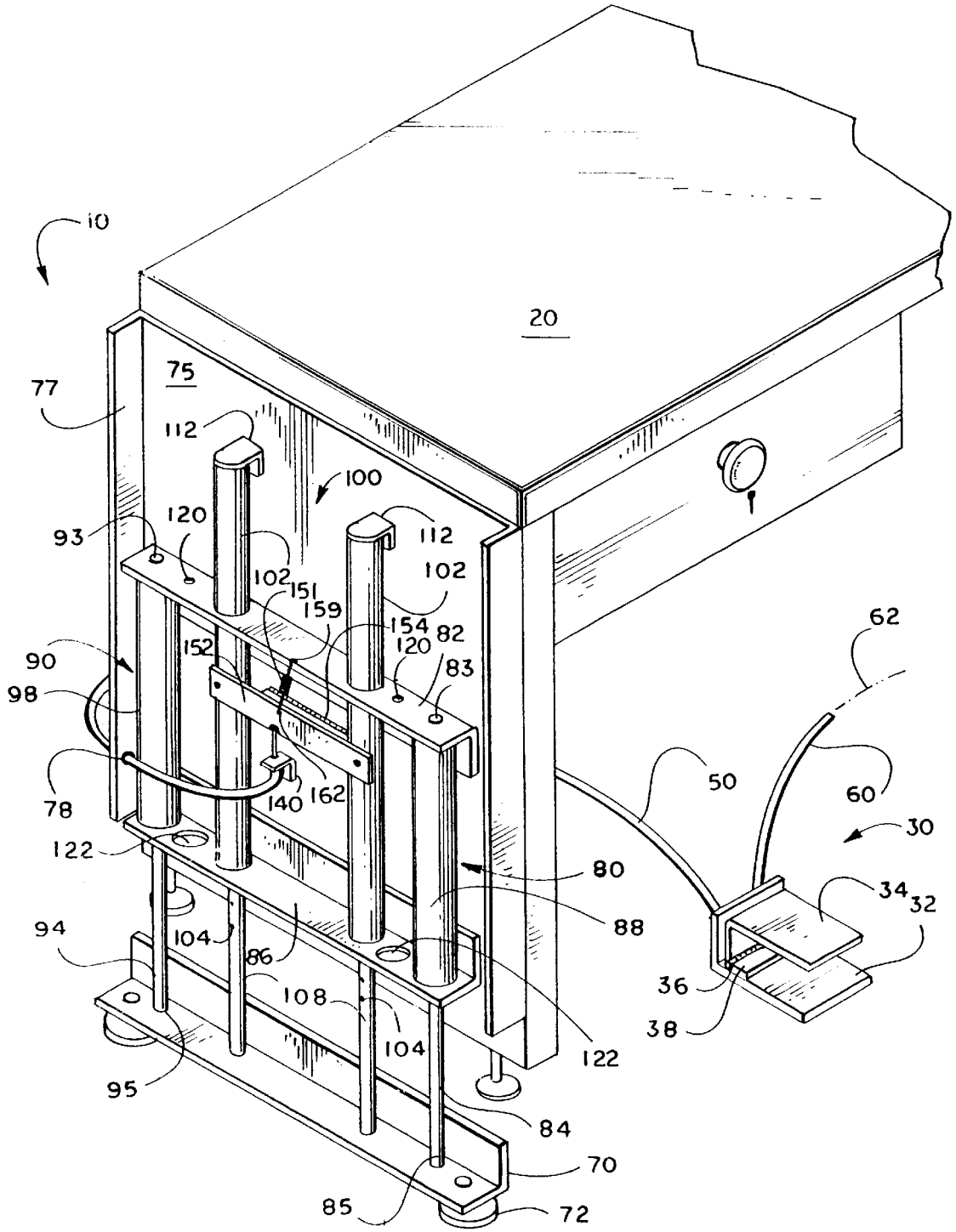
FIG. 1 is a partial perspective view showing the left side of the preferred embodiment of the present invention and the latch releasing pedal assembly of the preferred embodiment of the present invention interconnected to a desk.

It is to be noted that the drawings presented are intended solely for the purpose of illustration and that they are, therefore, neither desired nor intended to limit the invention to any or all of the exact details of construction shown, except insofar as they may be deemed essential to the claimed invention.

DETAILED DESCRIPTION OF THE PREFERRED EMBODIMENT

In describing preferred embodiments of the present invention, illustrated in FIGS. 1–3, specific terminology is employed for the sake of clarity. The invention, however, is not intended to be limited to the specific terminology so selected, and it is to be understood that each specific element includes all technical equivalents, which operate in a similar manner to accomplish a similar purpose.

Referring now to the Figures, there is shown the left side of a preferred embodiment of the present invention and the latch releasing pedal assembly of a preferred embodiment of the present invention, indicated generally by reference numeral 10. It is noted that the light side of device 10 is a mirror image of the left side; and, thus, the following description and detail of the left side of device 10 is equally applicable and fully descriptive of the right side of device 10.

Generally, then, device 10 comprises preferably latch releasing pedal assembly 30, first gas pressurized cylinder assembly 80, second gas pressurized cylinder assembly 90 and latching assembly mechanism 100.

In a preferred embodiment, first and second gas pressurized cylinder assembly 80 and 90, respectively, are spaced apart and are generally positioned near the front and rear corners, respectively, of the side of desk 20. First and second gas pressurized cylinder assembly 80 and 90, respectively, comprises gas pressurized cylinders 88 and 98, respectively, and plunger rods 84 and 94, respectively. Gas pressurized cylinders 88 and 98 are secured to device mounting frame 75 between upper L-shaped support bracket 82 and lower L-shaped support bracket 86. Both upper L-shaped support bracket 82 and lower L-shaped support bracket 86 are secured to device mounting frame 75 with bolts, screws or rivets. The upper portions of gas pressurized cylinder 88 and 98 are attached to upper L-shaped support bracket 82 via bolt 83 and 93, respectively, in a generally vertical position. Thus upper L-shaped support bracket 82 and lower L-shaped support bracket 86 are elongated parallel members extending generally the width of device mounting frame 75. At the point of contact of the lower portions of gas pressurized cylinder 88 and 98 with lower L-shaped support bracket 86, throughholes are formed in the lower L-shaped support bracket 86 and are dimensioned to allow cylinder 88 and 98 to extend freely therethrough. Distal ends 85 and 95 of plunger rods 84 and 94, respectfully, are welded or bolted in a fixed position to base member 70. Base member 70 is preferably angle iron and provides support for desk 20 when desk 20 is in a raised position. Base member 70 additionally serves to provide a pressure plate for transferring the force of gas pressurized cylinders 88 and 98 to upper L-shaped support bracket 82 for lifting desk 20. Base member 70 generally extends the width of the side of desk 20. For additional support and for aesthetic purposes, feet 72 are bolted or riveted to the underside of base member 70 at or near the proximal and distal ends of base member 70.

Gas pressurized cylinders 88 and 98 are selected based on the weight distribution of desk 20. For instance, if a larger percentage of the weight of desk 20 is carried by the front left corner of desk 20, due to the design of desk 20 and/or items typically kept in or on desk 20 by the user, gas pressurized cylinder 88 is selected accordingly to provide greater upward force to account for the variance in weight distribution. Therefore, desk 20 will be lifted uniformly to prevent any items on or in desk 20 from sliding or rolling off during the raising or lowering of desk 20. For ease of modification and convenience of use, additional holes 120 and 122 are formed in upper L-shaped support bracket 82 and lower L-shaped support bracket 86, respectively, adjacent to each gas pressurized cylinders 88 and 98 for receiving additional gas pressurized cylinders, if needed.

Latching assembly mechanism 100 comprises, generally, a pair of upper telescoping members 102, a pair of lower telescoping members 108, a pair of upper brackets 112, L-shaped cable guide 140, linear spring 151, L-shaped pin support member 152, hinge 154, hinge mounting plate 156, hinge connecting plate 158, and a pair of protruding pins 160. Telescoping members 102 and 108 are spaced apart from each other and vertically positioned between gas pressurized cylinders 88 and 98. Upper telescoping members 102 are held in a fixed position, relative to device mounting frame 75, between upper brackets 112 and lower L-shaped support bracket 86. Upper telescoping members 102 are bolted or screwed to upper brackets 112 at the top portions of upper telescoping members 102, and upper brackets 112 are bolted, screwed or riveted to device mounting frame 75. The bottom surfaces of upper telescoping members 102 rest upon lower L-shaped support bracket 86. For additional stability, upper telescoping members 102 extend through holes dimensioned in upper L-shaped support bracket 82. At the point of contact of the bottom surfaces of upper telescoping members 102 and lower L-shaped support bracket 86, throughholes are formed in the lower L-shaped support bracket 86 and are dimensioned to allow lower telescoping members 108 to extend freely therethrough, but is small enough to prevent the larger diameter upper telescoping members 102 from extending therethrough. As such, as desk 20 is raised and lowered, the smaller diameter lower telescoping members 108 freely telescope within the larger diameter upper telescoping members 102 to provide additional support/guidance and to provide a means for latching desk 20 in a desired position, as discussed below.

The latching means of device 10 is partially defined by protruding pins 160 that extend through a hole in upper telescoping member 102 and one of a plurality of vertically spaced throughholes 104 in lower telescoping member 108 to thereby prevent upward or downward movement of telescoping members 102 and 108 and, thus, desk 20. Protruding pins 160 are carried by preferably L-shaped pin support plate 152, which is thereby hinged 154 through hinge connecting plate 158 to hinge mounting plate 156. Hinge mounting plate 156 is bolted, screwed or riveted to device mounting frame 75 in a fixed position. L-shaped pin support plate 152 extends generally the length between the pair of upper telescoping members 102 and, thus, is generally perpendicular to the pair of upper telescoping members 102. Protruding pins 160 are positioned on L-shaped pin support plate 152 so as to align with the throughholes of the upper telescoping members 102 and one of the plurality of throughholes 104 of the lower telescoping members 108. As such, protruding pins 160 can pivot about the axis of hinge 154 thereby removing protruding pins 160 from throughholes 104 to allow movement of upper telescoping members 102 relative to lower telescoping members 108 and thus allow the upward or downward movement of desk 20.

In order to ensure that device 10 remains in the latched position (i.e., protruding pins 160 extending into throughholes 104) when desk 20 is not being raised or lowered, one end of linear spring 151 is attached to L-shaped pin support member 152 at throughhole 162, and the other end of linear spring 151 is attached to upper L-shaped support bracket 82 at throughhole 159. Linear spring 151 provides sufficient force to ensure that protruding pins 160 remain extending into throughholes 104 when device 10 is in a resting state. It should be noted that, based on the disclosure herein, it would be understood by one skilled in the art to use other means for ensuring that device 10 remains latched.

For instance, hinge 154 could be a helical spring hinge or torsion spring. In any such configuration, the spring serves to hold the pins 160 in place and, as discussed more fully hereinbelow, returns the foot pedal assembly 30 to the open position.

To allow a single user to easily disengage all protruding pins 160 simultaneously so that desk 20 may be evenly raised or lowered, device 10 incorporates latch releasing pedal assembly 30. Latch releasing pedal assembly 30 comprises L-shaped base member 32, first cable stop 33, L-shaped hinged member 34, first cable nut 35, hinge 36, connecting plate 38, second cable stop 43, second cable nut 45, first covered cable 50, first cable 52, second covered cable 60, second cable 62, L-shaped cable guide 140, third cable nut 142 and third cable stop 54. One side of L-shaped base member 32 and L-shaped hinged member 34 have two throughhole each formed therein for receiving first cable 52 and second cable 62. L-shaped hinged member 34 mates with L-shaped base member 32 in an inverted position with the throughholes within each respectively aligning. Connecting plate 38 is secured to L-shaped base member 32 and is connected to L-shaped hinged member 34 via hinge 36. One end of first covered cable 50 is attached at one of the throughholes in L-shaped base member 32 by first cable nut 35. First cable 52 extends through L-shaped base member 32 and L-shaped hinged member 34 and is secured to L-shaped hinged member 34 by first cable stop 33. The other end of first covered cable 50 is attached to L-shaped cable guide 140 by third cable nut 142. L-shaped cable guide 140 is secured to device mounting frame 75 and has a throughhole by which first cable 52 extends therethrough and attaches to L-shaped pin support member 152 through a throughhole therein by third cable stop 54. In order to ensure that first covered cable 50 does not interfere with the raising and lowering of desk 20 during operation, first covered cable 50 is channeled through slit or throughhole 78 formed in the lower portion of rear wall 77 of device mounting frame 75.

One end of second covered cable 60 is attached at one of the throughholes in L-shaped base member 32 by second cable nut 45. Second cable 62 extends through L-shaped base member 32 and L-shaped hinged member 34 and is secured to L-shaped hinged member 34 by second cable stop 43. The other end of second covered cable 60 is connected to the right side portion of device 10, which is an identical mirror image of the left side portion of device 10. As such, the above disclosure of the left side portion is fully applicable and descriptive of the right side portion of device 10. One each of the assembled device mounting frame 75 is attached to the left side and the right side of desk 20. Cover 12 is secured over device mounting frame 75 on both sides to prevent injury and to provide an aesthetically pleasing appearance.

In operation, the user, preferably, provides foot pressure to L-shaped hinged member 34 of latch releasing pedal assembly 30. As a result, first and second cable 52 and 62, respectively, are pulled in a generally inward direction of their resting position. Now referring only to the left side of device 10, the movement of first cable 52 results in the hinging of L-shaped pin support member 152, and, thus, the retraction of protruding pins 160 from throughholes 104. Accordingly, telescoping members 102 and 108 are freed, thereby allowing the force of gas pressurized cylinders 88 and 98 to slightly urge desk 20 in the upward direction. If the user is lowering desk 20, a light hand force can be applied to the top surface of desk 20 to overcome the slight upward urge. As previously discussed, all of the gas pressurized cylinders are chosen based on the weight distribution of the specific user's desk to overcome the weight of the desk and to provide a slight upward urging of the desk to eliminate the need for lifting by the user. However, it should be noted that a user may choose a set of gas pressurized cylinders such that the forces exerted in the upward direction is equal to or slightly less than the weight of the desk, depending on the user's preference.

Once the desk is placed at a desired height, L-shaped hinged member 34 of latch releasing pedal assembly 30 is released thereby allowing linear spring 151 to urge protruding pins 160 back to its resting latched state, thus extending into upper and lower telescoping members 102 and 108, respectively, via throughholes 104.

Having thus described exemplary embodiments of the present invention, it should be noted by those skilled in the art that the within disclosures are exemplary only and that various other alternatives, adaptations, and modifications may be made within the scope of the present invention. For instance, based upon the disclosure herein, it would be apparent to one skilled in the art to utilize separate upper and separate lower brackets for supporting the gas pressurized cylinders in lieu of the single piece upper bracket and single piece lower bracket as disclosed in the preferred embodiment. Accordingly, the present invention is not limited to the specific embodiments as illustrated herein, but is only limited by the following claims.

I claim:

1. A vertically adjustable desk lifting device for use on a desk having a first side and a second side, said lifting device comprising:

a first mounting frame having a first side and a second side, wherein said second side of said first mounting frame is attached to and facing the first side of the desk;

a second mounting frame having a first side and a second side, wherein said second side of said second mounting frame is attached to and facing the second side of the desk;

a first support base interconnected with said first mounting frame;

a second support base interconnected with said second mounting frame;

first urging means carried on said first side of said first mounting frame for urging a desk in the upward direction;

second urging means carried on said first side of said second mounting frame for urging a desk in the upward direction;

first hinged latching means carried on said first side of said first mounting frame for removably latching the desk in a desired vertical position;

second hinged latching means carried on said first side of said second mounting frame for removably latching the desk in a desired vertical position; and, means attached to said first side of said first mounting frame and to said first side of said second mounting frame for unlatching said first hinged latching means and said second hinged latching means, wherein said unlatching means serves to simultaneously unlatch said first hinged latching means and said second hinged latching means.

2. The device of claim 1, wherein said first urging means are at least two vertically positioned gas pressurized cylinders each having a plunging rod and a cylinder portion, said plunging rods of said first urging means rest against said first support base and said cylinder portion is fixed to said first side of said first mounting frame, whereby said plunging rods urge against said first support base thereby urging the first side of the desk in the upward direction; and, wherein said second urging means are at least two vertically positioned gas pressurized cylinders each having a plunging rod and a cylinder portion, said plunging rods of said second urging means rest against said second support base and said cylinder portion is fixed to said first side of said second mounting frame whereby said plunging rods urge against said second support base thereby urging the second side of the desk in the upward direction.

3. The device of claim 2, wherein said gas pressurized cylinders are selected to provide sufficient force to evenly raise the desk in the upward direction accounting for an uneven weight distribution of the desk.

4. The device of claim 1, wherein said first hinged latching means is defined by a hinged pin, an upper telescoping member, a lower telescoping member, a throughhole formed in said upper telescoping member and a plurality of throughholes vertically positioned in said lower telescoping member, said upper telescoping member is attached to said first side of said first mounting frame and said lower telescoping member is attached to said first base support so that said lower telescoping member remains in a fixed vertical position and said upper telescoping member travels with the vertical movement of the desk, wherein said lower telescoping member is telescoped within said upper telescoping member, one of said plurality of throughholes of said lower telescoping member aligns with said throughhole of said upper telescoping member and wherein said pin extends through said aligned throughholes to prevent vertical movement of said upper telescoping member and said lower telescoping member, thus preventing vertical movement of the first side of the desk.

5. The device of claim 1, wherein said second hinged latching means is defined by a hinged pin, an upper telescoping member, a lower telescoping member, a throughhole formed in said upper telescoping member and a plurality of throughholes vertically positioned in said lower telescoping member, said upper telescoping member is attached to said first side of said second mounting frame and said lower telescoping member is attached to said second base support so that said lower telescoping member remains in a fixed vertical position and said upper telescoping member travels with the vertical movement of the desk, wherein said lower telescoping member is telescoped within said upper telescoping member, one of said plurality of throughholes of said lower telescoping member aligns with said throughhole of said upper telescoping member and wherein said pin extends through said aligned throughholes to prevent vertical movement of said upper telescoping member, thus preventing vertical movement of the second side of the desk.

6. The device of claim 1, wherein said unlatching means comprises a foot pedal means, a first cable having a first end and a second end, and a second cable having a first end and a second end, said first end of said first cable and said first end of said second cable are attached to said foot pedal means, said second end of said first cable is attached to said first hinged latching means, said second end of said second cable is attached to said second hinged latching means, wherein when said foot pedal means is depressed, said first cable and said second cable are retracted thereby unlatching said first hinged latching means and said second hinged latching means.

7. The device of claim 6, wherein said foot pedal means comprises a base portion and a pedal portion, said pedal portion is hinged to said base portion wherein said pedal portion can move in a generally upward and downward direction.

8. A vertically adjustable desk lifting device for use on a desk having a first side and a second side, said lifting device comprising:

a first mounting frame having a first side and a second side, wherein said second side of said first mounting frame is attached to and facing the first side of the desk;

a second mounting frame having a first side and a second side, wherein said second side of said second mounting frame is attached to and facing the second side of the desk;

a first support base interconnected with said first mounting frame;

a second support base interconnected with said second mounting frame;

first urging means carried on said first side of said first mounting frame for urging a desk in the upward direction;

second urging means carried on said first side of said second mounting frame for urging a desk in the upward direction;

first hinged latching means carried on said first side of said first mounting frame for removably latching the desk in a desired vertical position;

second hinged latching means carried on said first side of said second mounting frame for removably latching the desk in a desired vertical position; and, a foot pedal unlatching means having a first cable, said first cable having a first end and a second end, and a second cable, said second cable having a first end and a second end, said first end of said first cable and said first end of said second cable are attached to said foot pedal unlatching means, said second end of said first cable is attached to said first hinged latching means, said second end of said second cable is attached to said second hinged latching means, wherein when said foot pedal means is depressed, said first cable and said second cable are retracted thereby simultaneously unlatching said first hinged latching means and said second hinged latching means.

9. The device of claim 8, wherein said first urging means are at least two vertically positioned gas pressurized cylinders each having a plunging rod and a cylinder portion, said plunging rods of said first urging means rest against said first support base and said cylinder portion is fixed to said first side of said first mounting frame, whereby said plunging rods urge against said first support base thereby urging the first side of the desk in the upward direction; and, wherein said second urging means are at least two vertically positioned gas pressurized cylinders each having a plunging rod and a cylinder portion, said plunging rods of said second urging means rest against said second support base and said cylinder portion is fixed to said first side of said second mounting frame, whereby said plunging rods urge against said second support base thereby urging the second side of the desk in the upward direction.

10. The device of claim 9, wherein said gas pressurized cylinders are selected to provide sufficient force to evenly raise the desk in the upward direction accounting for an uneven weight distribution of the desk.

11. The device of claim 8, wherein said first hinged latching means is defined by a hinged pin, an upper telescoping member, a lower telescoping member, a throughhole formed in said upper telescoping member and a plurality of throughholes vertically positioned in said lower telescoping member, said upper telescoping member is attached to said first side of said first mounting frame and said lower telescoping member is attached to said first base support so that said lower telescoping member remains in a fixed vertical position and said upper telescoping member travels with the vertical movement of the desk, wherein said lower telescoping member is telescoped within said upper telescoping member, one of said plurality of throughholes of said lower telescoping member aligns with said throughhole of said upper telescoping member and wherein said pin extends through said aligned throughholes to prevent vertical movement of said upper telescoping member and said lower telescoping member, thus preventing vertical movement of the first side of the desk.

12. The device of claim 8, wherein said second hinged latching means is defined by a hinged pin, an upper telescoping member, a lower telescoping member, a throughhole formed in said upper telescoping member and a plurality of throughholes vertically positioned in said lower telescoping member, said upper telescoping member is attached to said first side of said second mounting frame and said lower telescoping member is attached to said second base support so that said lower telescoping member remains in a fixed vertical position and said upper telescoping member travels with the vertical movement of the desk, wherein said lower telescoping member is telescoped within said upper telescoping member, one of said plurality of throughholes of said lower telescoping member aligns with said throughhole of said upper telescoping member and wherein said pin extends through said aligned throughholes to prevent vertical movement of said upper telescoping member, thus preventing vertical movement of the second side of the desk.

13. A vertically adjustable desk lifting device for use on a desk having a first side and a second side, said lifting device comprising:

a first mounting frame having a first side and a second side, wherein said second side of said first mounting frame is attached to and facing the first side of the desk;

a second mounting frame having a first side and a second side, wherein said second side of said second mounting frame is attached to and facing the second side of the desk;

a first support base interconnected with said first mounting frame;

a second support base interconnected with said second mounting frame;

at least one gas pressurized cylinder, said at least one gas pressurized cylinder having a plunging rod and a cylinder portion, said plunging rod rests against said first support base and said cylinder portion is fixed to said first side of said first mounting frame whereby said plunging rod urges against said first support base thereby urging the first side of the desk in the upward direction;

at least one gas pressurized cylinder, said at least one gas pressurized cylinder having a plunging rod and a cylinder portion, said plunging rod rests against said second support base and said cylinder portion is fixed to said first side of said second mounting frame whereby said plunging rod urges against said second support base thereby urging the second side of the desk in the upward direction;

first hinged latching means carried on said first side of said first mounting frame for removably latching the desk in a desired vertical position;

second hinged latching means carried on said first side of said second mounting frame for removably latching the desk in a desired vertical position; and, a foot pedal unlatching means having a first cable, said first cable having a first end and a second end, and a second cable, said second cable having a first end and a second end, said first end of said first cable and said first end of said second cable are attached to said foot pedal unlatching means, said second end of said first cable is attached to said first hinged latching means, said second end of said second cable is attached to said second hinged latching means, wherein when said foot pedal means is depressed, said first cable and said second cable are retracted thereby simultaneously unlatching said first hinged latching means and said second hinged latching means.

14. The device of claim 13, wherein said gas pressurized cylinders are selected to provide sufficient force to evenly raise the desk in the upward direction accounting for an uneven weight distribution of the desk.

15. The device of claim 13, wherein said first hinged latching means is defined by a hinged pin, an upper telescoping member, a lower telescoping member, a throughhole formed in said upper telescoping member and a plurality of throughholes vertically positioned in said lower telescoping member, said upper telescoping member is attached to said first side of said first mounting frame and said lower telescoping member is attached to said first base support so that said lower telescoping member remains in a fixed vertical position and said upper telescoping member travels with the vertical movement of the desk, wherein said lower telescoping member is telescoped within said upper telescoping member, one of said plurality of throughholes of said lower telescoping member aligns with said throughhole of said upper telescoping member and wherein said pin extends through said aligned throughholes to prevent vertical movement of said upper telescoping member and said lower telescoping member, thus preventing vertical movement of the first side of the desk.

16. The device of claim 13, wherein said second hinged latching means is defined by a hinged pin, an upper telescoping member, a lower telescoping member, a throughhole formed in said upper telescoping member and a plurality of throughholes vertically positioned in said lower telescoping member, said upper telescoping member is attached to said first side of said second mounting frame and said lower telescoping member is attached to said second base support so that said lower telescoping member remains in a fixed vertical position and said upper telescoping member travels with the vertical movement of the desk, wherein said lower telescoping member is telescoped within said upper telescoping member, one of said plurality of throughholes of said lower telescoping member aligns with said throughhole of said upper telescoping member and wherein said pin extends through said aligned throughholes to prevent vertical movement of said upper telescoping member, thus preventing vertical movement of the second side of the desk.

* * * * *